US006378993B1

(12) United States Patent
Ozaki et al.

(10) Patent No.: US 6,378,993 B1
(45) Date of Patent: Apr. 30, 2002

(54) LIQUID DISCHARGE HEAD, PRODUCING METHOD THEREFOR AND LIQUID DISCHARGE APPARATUS

(75) Inventors: Teruo Ozaki; Ichiro Saito, both of Yokohama; Toshio Kashino, Chigasaki; Yoshiyuki Imanaka, Kawasaki; Masahiko Kubota, Tokyo; Muga Mochizuki, Yokohama; Yoshiaki Kurihara, Kawasaki; Masashi Miyagawa, Yokohama; Shuji Koyama, Kawasaki, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/452,184

(22) Filed: Dec. 2, 1999

(30) Foreign Application Priority Data

Dec. 3, 1998 (JP) ..... 10-344728

(51) Int. Cl.[7] ..... B41J 2/05
(52) U.S. Cl. ..... 347/65; 347/63
(58) Field of Search ..... 347/65, 63, 70, 347/71, 48, 56

(56) References Cited

U.S. PATENT DOCUMENTS

| | | | | |
|---|---|---|---|---|
| 4,723,129 A | | 2/1988 | Endo et al. | 347/56 |
| 5,582,678 A | * | 12/1996 | Komuro | 216/27 |
| 6,154,237 A | | 11/2000 | Kashino et al. | 347/48 |
| 6,168,264 B1 | | 1/2001 | Yoshihira et al. | 347/65 |
| 6,196,667 B1 | | 3/2001 | Hiroki et al. | 347/65 |

FOREIGN PATENT DOCUMENTS

| | | |
|---|---|---|
| EP | 636481 | 2/1995 |
| EP | 721841 | 7/1996 |
| EP | 9048127 | 2/1997 |
| EP | 9201966 | 8/1997 |
| EP | 819536 | 1/1998 |

* cited by examiner

*Primary Examiner*—N. Le
*Assistant Examiner*—Lamson D. Nguyen
(74) *Attorney, Agent, or Firm*—Fitzpatrick, Cella, Harper & Scinto

(57) ABSTRACT

There is provided a liquid discharge head provided with an element substrate and a ceiling plate fixed in a mutually opposed state, plural liquid path lateral walls provided between the ceiling plate and the element substrate and defining plural light flow paths, plural discharge energy generating elements arranged in parallel on the surface of the element substrate so as to be respectively positioned in the plural liquid paths, plural movable members in the form of a beam supported at an end, provided on the element substrate so as to be respectively opposed to the plural discharge energy generating elements and provided with fixed ends at the upstream side in the liquid flowing direction in the liquid paths and free ends at the downstream ends, and plural projections provided on the ceiling plate for respectively limiting the amount of displacement of the plural movable members, the element substrate and the ceiling plate being composed of similar materials, wherein the liquid path lateral walls are formed on the element substrate, and, on the ceiling plate, there is provided an engaging layer having recesses for fitting with the upper end faces of the liquid path lateral walls.

10 Claims, 7 Drawing Sheets

LIQUID DISCHARGE HEAD, PRODUCING METHOD THEREFOR AND LIQUID DISCHARGE APPARATUS

BACKGROUND OF THE INVENTION

1. Field of the Invention

The present invention relates to a liquid discharge head for discharging desired liquid by generation of a bubble induced by action of thermal energy on the liquid, and more particularly to the configuration of a liquid discharge head having a movable member which is displaced by the generation of the bubble, a producing method therefor and a liquid discharge apparatus utilizing the liquid discharge head.

The present invention is applicable to an apparatus such as a printer for recording on various recording media such as paper, yarn, fiber, cloth, metal, plastics, glass, timber or ceramics, a copying apparatus, a facsimile apparatus provided with a communication system, or a word processor equipped with a printer unit, or to industrial recording apparatus combined with various processing apparatus.

In the present invention, the "recording" means not only providing the recording medium with a meaningful image such as a character or a graphics but also with a meaningless image such as a pattern.

2. Related Background Art

There is already known so-called bubble jet recording method, namely an ink jet recording method of providing ink with an energy such as heat to cause a state change (bubble generation) involving an abrupt volumic change in the ink, discharging ink from the discharge opening by an action force based on such state change and depositing the ink onto a recording medium to form an image. The recording apparatus employing such bubble jet recording method is generally provided, as disclosed in the U.S. Pat. No. 4,723,129, with a discharge opening for discharging ink, an ink path communicating with the discharge opening and an electrothermal converting member provided in the ink path and serving as energy generating means for generating energy for discharging the ink.

Such recording method has various advantages for example of recording an image of high quality at a high speed with a low noise level, and recording an image of a high resolution or even a color image with a compact apparatus since, in the head executing such recording method, the ink discharge openings can be arranged with a high density. For this reason, the bubble jet recording method is recently employed in various office equipment such as printers, copying machines, facsimile apparatus etc., and even in industrial systems such as fabric dyeing apparatus.

With the spreading of the bubble jet technology into various fields, there are appearing various demands explained in the following.

For example, in order to satisfy a demand for improving the energy efficiency, there is conceived optimization of the heat generating member, such as adjustment of the thickness of the protective film for the heat generating member. This method is effective in improving the efficiency of propagation of the generated heat to the liquid.

Also for obtaining the image of high quality, there is proposed a driving method for liquid discharge capable of realizing a faster ink discharging speed and satisfactory ink discharge based on stable bubble generation, and, for achieving high-speed recording, there is proposed an improved shape of the liquid path for realizing the liquid discharge head with a faster refilling speed of the liquid into the liquid path.

For example the Japanese Patent Application Laid-Open No. 9-201966 discloses a configuration of providing a movable member in the liquid path, thereby stabilizing the discharge. Also the Japanese Patent Application Laid-Open No. 9-48127 discloses a configuration of controlling the moving range of the movable member. However these references do not teach the specific method of forming these configurations.

SUMMARY OF THE INVENTION

The object of the present invention is to provide a liquid discharge head capable of attaining both the improvement in the discharge characteristics and the improvement in the frequency of liquid discharge with a simple configuration, a producing method therefor and a liquid discharge apparatus.

The foregoing object can be attained, according to the present invention, by a liquid discharge head provided with an element substrate and a ceiling plate fixed in a mutually opposed state, plural liquid path lateral walls provided between the ceiling plate and the element substrate and defining plural liquid flow paths, plural discharge energy generating elements arranged in parallel on the surface of the element substrate so as to be respectively positioned in the plural liquid paths, plural movable members in the form of a cantilever supported at an end, provided on the element substrate so as to be respectively opposed to the plural discharge energy generating elements and provided with fixed ends at the upstream side in the liquid flowing direction in the liquid paths and free ends at the downstream ends, and plural projections provided on the ceiling plate for respectively limiting the amount of displacement of the plural movable members, the element substrate and the ceiling plate having similar materials, wherein the liquid path lateral walls are formed on the element substrate, and, on the ceiling plate, there is provided an engaging layer having recesses for fitting with the upper end faces of the liquid path lateral walls.

Further, in order to attain the above object, the invention provides a liquid discharge head provided with an element substrate and a ceiling plate fixed in a mutually opposed state, plural liquid path lateral walls provided between said ceiling plate and said element substrate and defining plural liquid flow paths, plural discharge energy generating elements arranged in parallel on the surface of said element substrate so as to be respectively positioned in said plural liquid paths, plural movable members in the form of a cantilever supported at an end, provided on said element substrate so as to be respectively opposed to said plural discharge energy generating elements and provided with fixed ends at the upstream side in the liquid flowing direction in said liquid paths and free ends at the downstream ends, and plural projections provided on said ceiling plate for respectively limiting the amount of displacement of said plural movable members, said element substrate and said ceiling plate having similar materials, wherein said liquid path lateral walls are formed on said element substrate, and, on said ceiling plate, there is provided an engaging layer having said projections.

In such configurations, because the element substrate and the ceiling plate contain similar materials, these components have little difference in the linear expansion coefficient, whereby there can be suppressed the deformation resulting from the rise in temperature after assembling. Also by forming a projection with a thick film process employing silicon nitride on a silicon substrate, there can be obtained a chemically stable configuration which is not affected by the ink components. Also as the liquid path lateral walls are formed on the element substrate and the ceiling plate is provided with recesses for engaging with the upper end faces of the liquid path lateral walls, there can be improved the adhesion property of the element substrate, liquid path lateral walls and ceiling plate, and there can also be improved the hermetic property of the liquid path.

It is also preferred to include a step of depositing an inorganic material layer on the ceiling plate consisting of an inorganic material and partially removing such inorganic material layer to form the projection and the recess.

According to the present invention, the liquid path lateral wall of the substrate and the recess of the ceiling plate are mutually fitted to improve the hermetic property of the liquid path. Also the substrate and the ceiling plate can be adhered easily and precisely by closing the recess of the ceiling plate and abutting the ceiling plate and the substrate at the adhering operation.

Furthermore, by forming all the ceiling plate, projection and element substrate with inorganic materials, there can be suppressed the deformation resulting from the temperature change after the manufacture because of the limited difference in the linear expansion coefficients.

DESCRIPTION OF THE PREFERRED EMBODIMENTS

[First Embodiment]

In the following there will be explained an embodiment of the present invention, with reference to the accompanying drawings.

Figure 1:
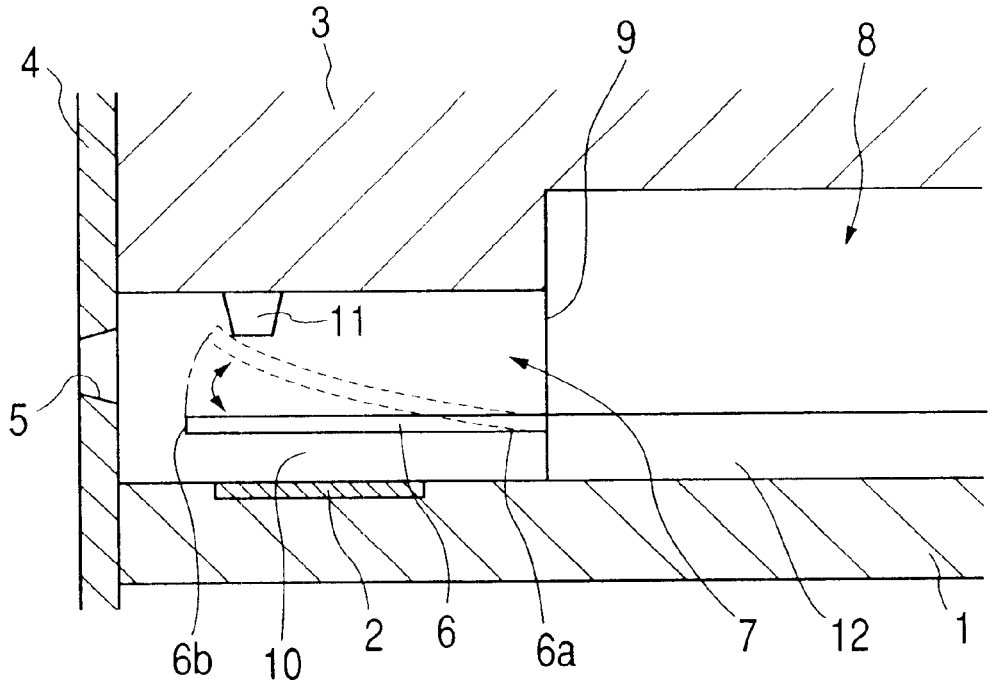
FIG. 1 is a cross-sectional view in a direction along the liquid flow path, showing the basic configuration of a liquid discharge head constituting a first embodiment of the present invention.

FIG. 1 is a cross-sectional view along the direction of the liquid flow path, showing the basic configuration of a liquid discharge head constituting a first embodiment of the present invention. The liquid discharge head of the present embodiment is provided, as shown in FIG. 1, with an element substrate 1 on which provided, in parallel manner, are plural heat generating members 2 (only one being illustrated in FIG. 1) constituting discharge energy generating elements for generating thermal energy for generating bubbles in the liquid, a ceiling plate 3 adhered onto the element substrate 1, and an orifice plate 4 adhered to the front end face of the element substrate 1 and the ceiling plate 3.

The element substrate 1 is formed by forming a silicon oxide film or a silicon nitride film for electrical insulation and heat accumulation on a substrate such as of silicon and patterning thereon an electrical resistance layer constituting the heat generating member 2 and wirings therefor. The wirings serve to apply a voltage to the electrical resistance layer to induce a current therein, thereby generating heat in the heat generating member 2. On the wirings and the electrical resistance layer, there is formed a protective film for protection from the ink, and an anticavitation film is formed thereon for protection from the cavitation resulting from the vanishing of the ink bubble.

On the element substrate 1, there is provided a movable member 6 in the form of a cantilever, so as to be opposed to the heat generating member 2. The movable member 6 is formed by a photolithographic process and patterning, on the element substrate 1, of silicon nitride of a thickness of 20 to 50 $\mu$m formed for example by plasma CVD.

The movable member 6 has the form of a cantilever supported at an end, and is so positioned as to be opposed to and to cover the heat generating member 2 with a predetermined distance therefrom, with a fulcrum 6*a* at the upstream side in the main liquid flow caused by the liquid discharging operation from a common liquid chamber 8 through the movable member 6 to a discharge opening (port) 5 and a free end 6*b* at the downstream side of the fulcrum 6*a*. The fixing end side of the movable member 6 is fixedly supported by a support member 12. The space between the movable member 6 and the heat generating member 2 constitutes a bubble generating area 10.

On the surface of the element substrate 1, there are also formed liquid path lateral walls 9 for defining a liquid path 7 corresponding to each heat generating member. The lateral walls 9 limiting the liquid path 7 have to be stable against ink flowing into the liquid path 7, namely have to show little dissolution or little shape change by the ink. Therefore, the liquid path lateral walls 9 are most preferably formed with silicon nitride, by plasma CVD deposition with a thickness of 20 to 50 $\mu$m on the element substrate 1 followed by photolithographic patterning and etching.

The ceiling plate 3 is to be adhered to the upper end faces of the plural liquid path lateral walls 9 corresponding to the heat generating members 2, and is provided with a common liquid chamber 8 for supplying the liquid paths 7 with the ink. The ceiling plate 3 is composed of a silicon-containing material, and is provided, on a face to be adhered to the liquid path lateral walls 9, with a recessed common liquid chamber 8, and an engaging layer 11*a* having a projection (limiting portion) 11 for limiting the displacement of the movable member 6 and shallow recesses 20 to be fitted with the liquid path lateral walls.

The projection 11 and the recess 20 can be formed simply and precisely by forming these in the engaging layer 11*a* separate from the ceiling plate 3. Also the position of the projection 11 can be determined easily, since the recess 20 and the projection 11, both relating to the positioning of the ceiling plate 3, are formed in the engaging layer 11*a*.

Furthermore, since the projection 11 is not isolated but formed in the engaging layer, it is rendered possible to prevent detachment thereof at the adhesion of the ceiling plate or even in case the movable member displaces with a high frequency. In the present embodiment, the engaging layer is explained as a single layer, but it may also be divided into plural layers if they are formed with similar materials. By forming the engaging layer 11*a* with a material similar to that of the liquid path lateral walls, at least three faces of the liquid path can be composed of similar materials, having approximately same liquid flow characteristics.

Figure 2A:
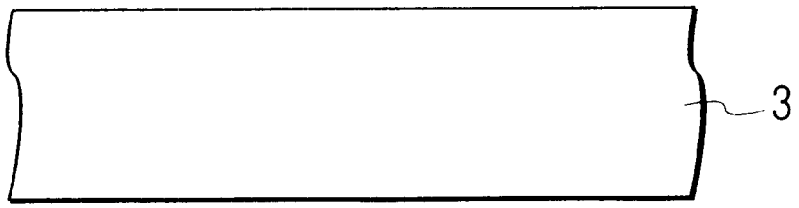
FIGS. 2A, 2B and 2C are views showing the method for producing a projection in the liquid discharge head shown in FIG. 1.
Figure 2B:
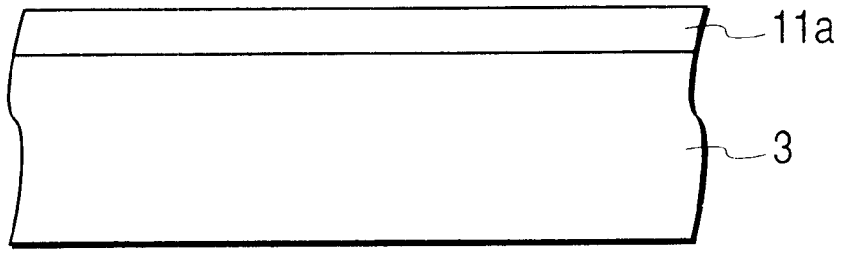
Figure 2C:
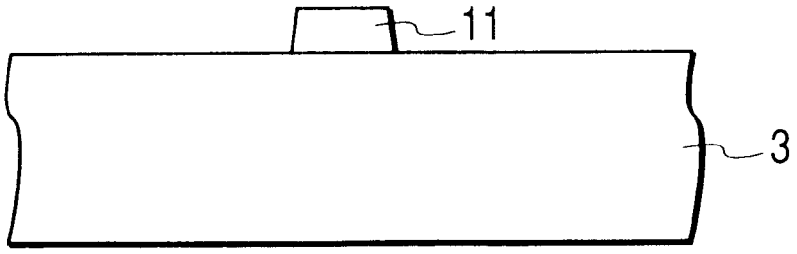

In the present embodiment, recessed portions such as the common liquid chamber 8 in the ceiling plate 3 are formed by anisotropic etching. Also, on the ceiling plate 3 consisting of a silicon substrate as shown in FIG. 2A, a silicon nitride (SiN) layer 11 of a thickness of 20 to 50 $\mu$m is formed by plasma CVD at about 400° C. as shown in FIG. 2B, and then a surfacial part of the SiN layer is removed by patterning and etching as shown in FIG. 2C to form the projection 11 and the shallow recess 20.

Figure 3:
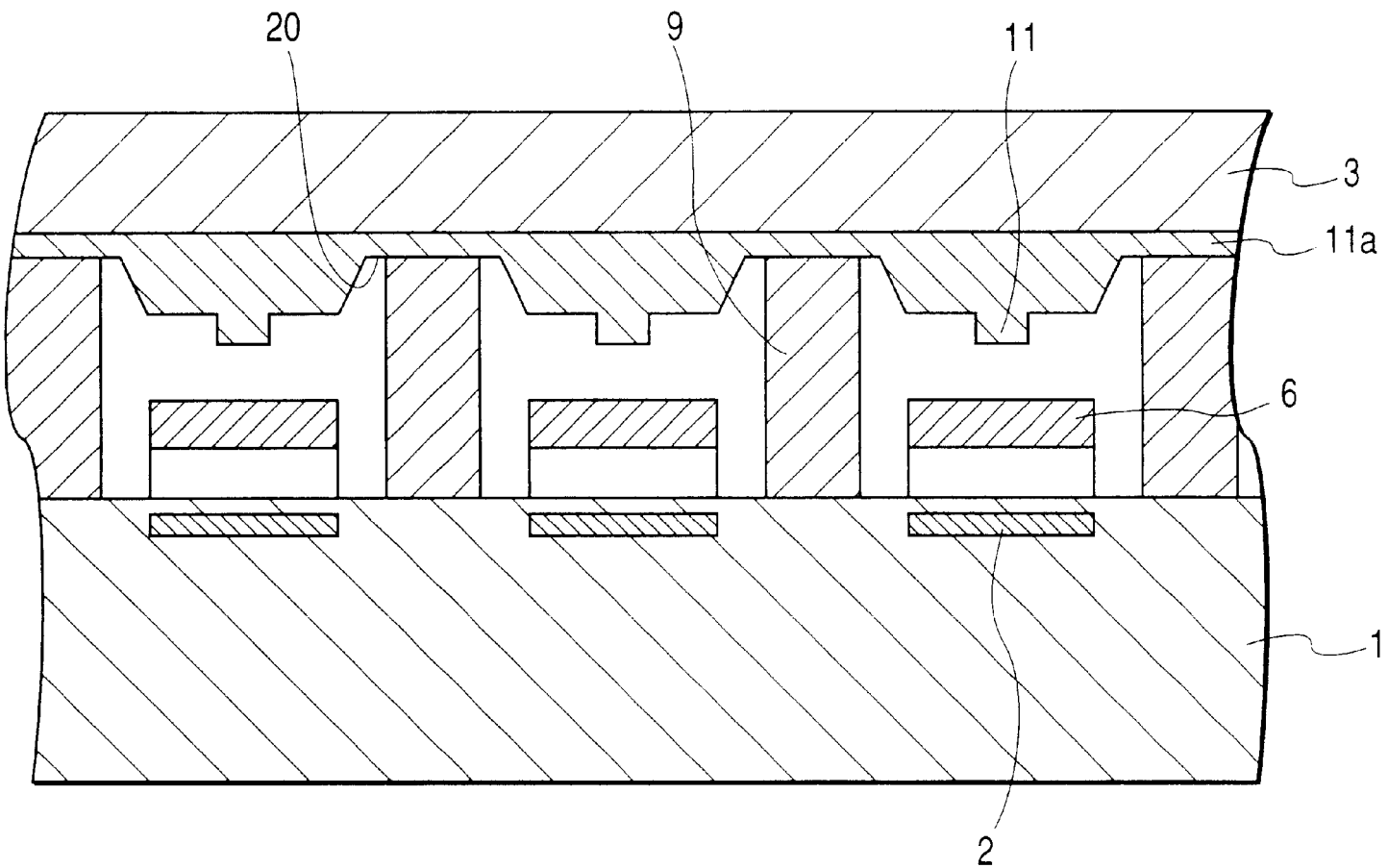
FIG. 3 is an elevation view, seen from the side of the discharge opening, showing the basic configuration of the liquid discharge head constituting the first embodiment of the present invention.

FIG. 3 is a cross-sectional view of these heat generating members along the direction of array thereof.

When the heat generating member 2 generates heat in the above-described configuration, heat is applied to the liquid (ink) in the bubble generating area 10 between the movable member 6 and the heat generating member 2, whereby a bubble is generated and grows on the heat generating member 2, based on the film boiling phenomenon. The pressure resulting from the growth of the bubble preferentially acts on the movable member 6, whereby the movable member 6 displaces so as to open widely toward the discharge opening 5 about the fulcrum 6*a,* as indicated by a broken line in FIG. 1. The displacement of the movable member 6 guides the pressure based on bubble generation and the growth of the bubble itself toward the discharge opening 5, whereby the liquid is discharged therefrom.

Thus, by positioning the movable member 6 on the bubble generating area 10, with the fulcrum 6*a* at the upstream side (side of common liquid chamber 8) of the liquid flow in the liquid path 7 and with the free end 6*b* at the downstream side (side of discharge opening 5), the propagation of the bubble pressure is guided toward the downstream side whereby the bubble pressure directly and efficiently contributes to the liquid discharge. Also the growing direction itself of the bubble is guided toward the downstream side, like the direction of pressure propagation, whereby the bubble grows larger in the downstream side than in the upstream side. Such control of the growing direction itself of the bubble and the propagating direction of the bubble pressure by the movable member allow to improve the fundamental discharging characteristics such as the discharge efficiency, discharge force or discharge speed.

In the present embodiment, the movable member 6 cannot move upwards beyond the broken-lined displacement position because of the presence, on the ceiling plate 3, of the projection 11, for limiting the movement of the movable member 6. Stated differently, the movable member 6 does not execute unnecessary deformation, beyond the deformation required for controlling the growing direction itself of the bubble and controlling the propagating direction of the bubble pressure.

When the heating is terminated by the end of activation of the heat generating member, the bubble starts to vanish. With the vanishing of the bubble, the force applied to the movable member 6 decreases and the movable member 6 returns to the initial state. The bubble shrinks rapidly by the multiplying effect with the elastic force of the movable member 6, whereby it eventually returns to the solid-lined initial position shown in FIG. 1. In the present embodiment, since the displacement of the movable member 6 is limited by the projection 11 and does not become unnecessarily large, the movable member returns fast and efficiently at the bubble vanishing.

In order to compensate the volumic shrinkage of the bubble in the bubble generating area 10 and the volume of the discharged liquid, the liquid flows in from the common liquid chamber 8 to achieve liquid refilling into the liquid path 7, and such liquid refilling is achieved efficiently, reasonably and stably in cooperation with the returning operation of the movable member 6.

In the present embodiment, as explained in the foregoing, the movable member 6 is utilized to achieve stable liquid discharge and to guide the bubble growth toward the discharge opening 5, thereby improving the discharge characteristics. Also limitation of the displacement of the movable member 6 by the projection 11 enables faster returning operation of the movable member 6, thereby increasing the liquid discharge frequency while maintaining improvement in the discharge characteristics. Furthermore, in the present embodiment, the ceiling plate 3 is provided with recesses to be fitted with the liquid path lateral walls, whereby there are reduced the aberration in the direction of array of the heat generating members and the gap by such fitting, thereby reducing the pressure loss.

[Second Embodiment]

Figure 4A:
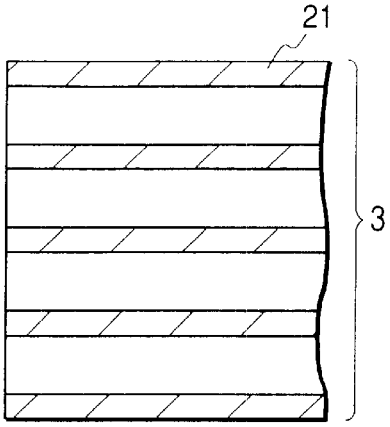
FIGS. 4A, 4B, 4C, 4D, 4E and 4F are views showing a liquid discharge head constituting a second embodiment of the present invention.
Figure 4B:
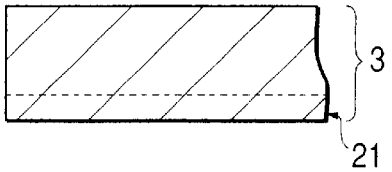

In the following there will be explained a second embodiment of the present invention, with reference to FIGS. 4A to 4F. The configuration of the first embodiment is formed as shown in FIGS. 4A and 4B, but there is required a sufficient accuracy on the position of the simultaneously formed projection. As the amount of displacement of the movable member is limited by the projection 11 a shown in FIG. 1, the eventual aberration in the designed positions of the projection 11 and the movable member varies the discharge amount, thus causing a fluctuation in the discharge characteristics. For this reason there is required a sufficient accuracy in the adhering operation of the element substrate and the ceiling plate.

Figure 4C:
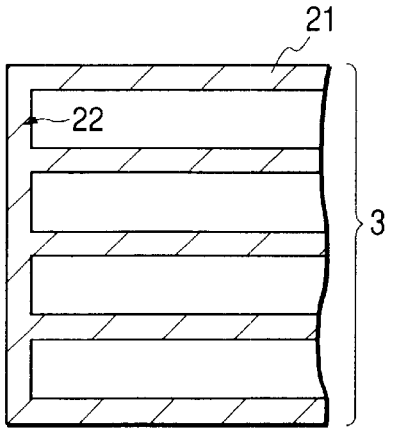
Figure 4D:
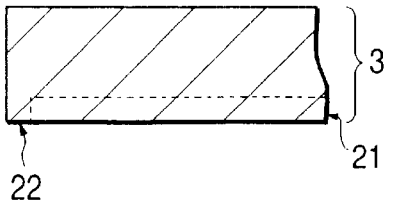

In the second embodiment, in order to simplify the adhering operation, the recesses of the walls at the side of the discharge openings are closed as indicated by 22 in FIGS. 4C and 4D.

Figure 4E:
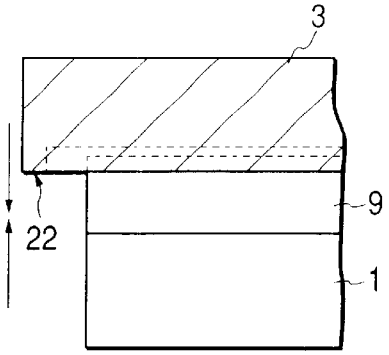
Figure 4F:
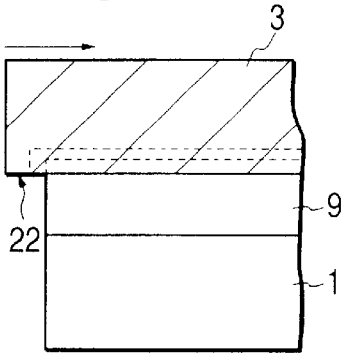

Thus, at first the ceiling plate 3 and the element substrate 1 are fitted together as shown in FIG. 4E, and then the ceiling plate 3 is moved until the lateral walls 9 abut on the closed portions 22 of the recesses of the ceiling plate 3, whereby the relative position of the movable member and the projection on the ceiling plate can be determined precisely.

[Third Embodiment]

In the following there will be explained a third embodiment of the present invention with reference to the accompanying drawings.

Figure 7:
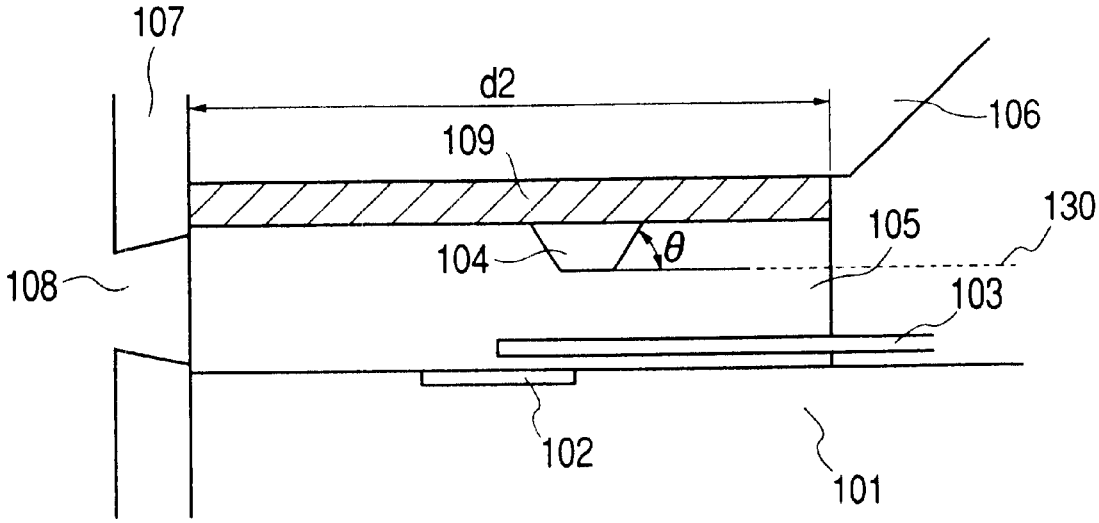
FIG. 7 is a schematic cross-sectional view of a liquid discharge head constituting a third embodiment of the present invention.

FIG. 7. is a schematic view showing an embodiment of the liquid discharge head of the present invention.

The liquid discharge head of the present embodiment is of a so-called edge shooter type, having a discharge opening 108 perpendicularly to the heat generating surface of a heat-generating resistance member 102. The liquid discharge head is composed of an element substrate 101, a ceiling plate 106, and an orifice plate 107. The element substrate 101 is provided with plural heat-generating resistance members 102, formed by a semiconductor process and used for bubble generation. Liquid path walls 105 for forming liquid paths are formed with a pitch that is the same as that of the heat-generating resistance members 102. A movable member 103 in the form of a beam supported at an end is so provided as to cover the heat-generating resistance member 102. The movable member 103 is composed of an elastic material such as a metal or a silicon-containing material. A limiting portion 104 is positioned above the movable member 103 a distance of about 20 μm therefrom, in order to limit the upward displacement thereof. A ceiling plate 106 is subjected to the formation of a liquid chamber and ink supply apertures by anisotropic etching, then is given a uniform photosensitive resin layer, for example, by coating or laminating, and an adhesion-improving layer 109 and a limiting portion 104 are formed by a photolithographic process. The element substrate 101 and the ceiling plate 106 are mutually adhered with an adhesive material or by a spring. An orifice plate 107 is provided with a discharge opening 108 for discharging liquid. In the present embodiment, a resinous sheet material is worked with an excimer laser.

The positional relationship of the adhesion improving layer 109 and the limiting portion 104 can be controlled in the order of micrometer, since these components are formed by a photolithographic process and laser working technology and the liquid path length d2 can be determined at the upstream end of the adhesion improving layer 109, whereby the refilling frequency can be stabilized.

The material constituting the adhesion improving layer 109 and the limiting portion 104 can be suitably selected from resinous materials. Specific examples of such material include cured epoxy resin, polyimide resin, polyetheramide resin and aramid resin. A particularly preferred example is the cured epoxy resin having photosensitivity, as it firmly adheres to the limiting portion 104. Also a preferred example is the cured epoxy resin, as it can be formed with a satisfactory positional relationship to the limiting portion by a photolithographic process, through the selection of a cationic photopolymerization initiator.

A tapered shape effective for ink refilling can be formed suitably by using a gradation mask, increasing the high molecular weight component in the UV curable resinous material, or employing a defocus state at the UV exposure.

The limiting portion can also be formed by ablation with the KrF excimer laser light of a wavelength of 248 nm, utilizing a resinous material containing a benzene ring in the molecular structure of the resin. A tapered shape can be obtained in the ablation process, by utilizing a gradation laser mask. Also the depth of formed recess can be controlled in the unit of a micrometer by varying the number of pulses.

The limiting portion 104 is so shaped as to have an angle θ, with respect to the exposure reference plane (contact surface with the movable member) within a range of 100° to 45°, preferably 90° to 60°. An angle larger than 100° lowers the ink refilling efficiency, because ink does not flow in a certain portion. Also with an angle smaller than 45°, the dimension of the lower face of the limiting portion becomes excessively large with respect to the dimension of the upper face thereof necessary for satisfying the requested function, whereby the resistance to the ink flow increases to deteriorate the ink refilling efficiency. The thickness of the adhesion improving layer 109 is within a range of 1 to 50 μm, preferably 20 to 35 μm.

A thickness exceeding 50 μm increases the internal stress (film stress) in the resin, eventually leading to defective adhesion to the ceiling plate 3. Also if the thickness is smaller than 1 μm, the aforementioned effects may not be fully exploited. A liquid discharge head of the configuration shown in FIG. 7 was prepared according to the steps described above. In the present embodiment, the steps were conducted in the following manner.

Photosensitive epoxy resin was laminated on the ceiling plate 106 in order to form the adhesion improving layer 109. The resin was exposed to the pattern of the adhesion improving layer 109 by a mirror projection mask aligner (MPA-600 manufactured by Canon Co.) and was subjected to PEB (post-exposure bake) for 5 minutes at 90° C. Then photosensitive epoxy resin was laminated in order to form the limiting portion 104. After an exposure with the mask aligner as explained above, PEB was conducted for 5 minutes at 90° C. At the exposure, the focus position was shifted upwards by 30 μm from the exposure reference plane 130 of the limiting portion, thereby obtaining the above-mentioned angle of 80° C. Development with an organic solvent was conducted to dissolve the unexposed portion, thereby collectively forming the adhesion improving layer 109 and the limiting portion 104. Thereafter the exposed portions were completely cured by a bake for 1 hours at 200° C.

The ceiling plate 3 bearing the adhesion improving layer 109 and the limiting portion 104, and the element substrate 101 on which the liquid path walls 105 were formed were adhered with an epoxy adhesive material, and the orifice plate bearing the discharge opening was similarly adhered with an adhesive material to obtain an ink jet discharge element.

The element was subjected to an evaluation of ink discharge with a frequency of 18 kHz. There was obtained satisfactory result of printing, and the refilling frequency was as high as 20 kHz. Also there was no peeling of the limiting portion 104 after a discharge durability test with $10^8$ pulses.

[Fourth Embodiment]

Figure 8:
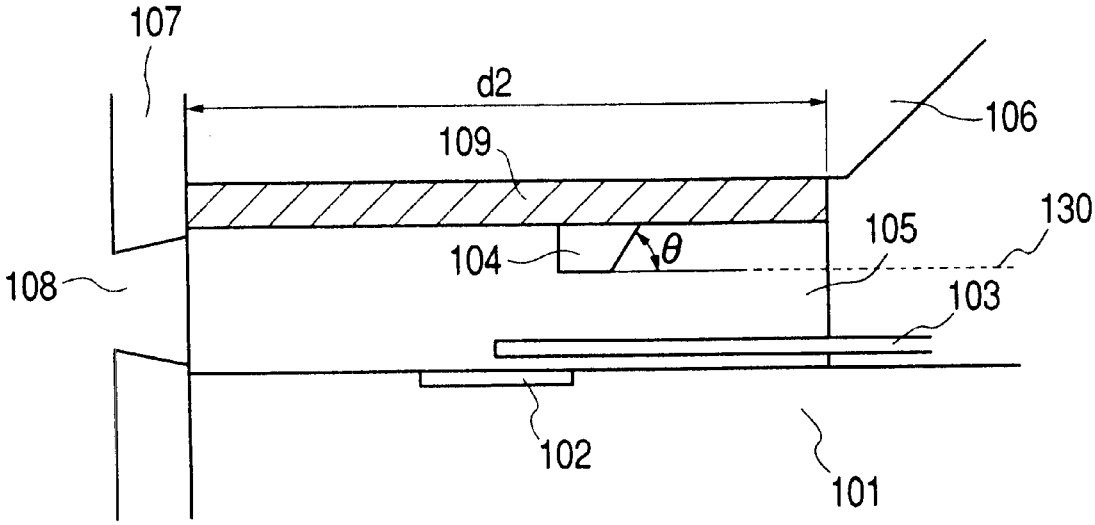
FIG. 8 is a schematic cross-sectional view of a liquid discharge head constituting a fourth embodiment of the present invention.

A liquid discharge head of the configuration shown in FIG. 8 was prepared according to the steps described above. In the present embodiment, the steps were conducted in the following manner.

Photosensitive epoxy resin was laminated on the ceiling plate 106 in order to form the adhesion improving layer 109. The resin was exposed to the pattern of the adhesion improving layer 109 by a mirror projection mask aligner (MPA-600 manufactured by Canon Co.) and was subjected to PEB (post-exposure bake) for 5 minutes at 90° C. Then photosensitive epoxy resin was laminated in order to form the limiting portion 104. After an exposure with the mask aligner as explained above, PEB was conducted for 5 minutes at 90° C. At the exposure, the focusing was made at the exposure reference plane 130 of the limiting portion, thereby obtaining the above-mentioned angle of 90°. Development with an organic solvent was conducted to dissolve the unexposed portion, thereby collectively forming the adhesion improving layer 109 and the limiting portion 104. Thereafter the exposed portions were completely cured by a bake for 1 hour at 200° C. Thereafter the liquid path upstream of the limiting portion 104 was shaped as shown in FIG. 8, with an excimer laser beam. A desired angle can be obtained by employing a gradation mask at the laser beam working.

The ceiling plate 3 bearing the adhesion improving layer 109 and the limiting portion 104, and the element substrate 101 on which the liquid path walls 105 were formed were adhered with an epoxy adhesive material, and the orifice plate bearing the discharge opening was similarly adhered with an adhesive material to obtain an ink jet discharge element.

The element was subjected to an evaluation of ink discharge with a frequency of 18 kHz. There was obtained satisfactory result of printing, and the refilling frequency was as high as 20 kHz. Also there was no peeling of the limiting portion 104 after a discharge durability test with $10^8$ pulses.

Figure 5:
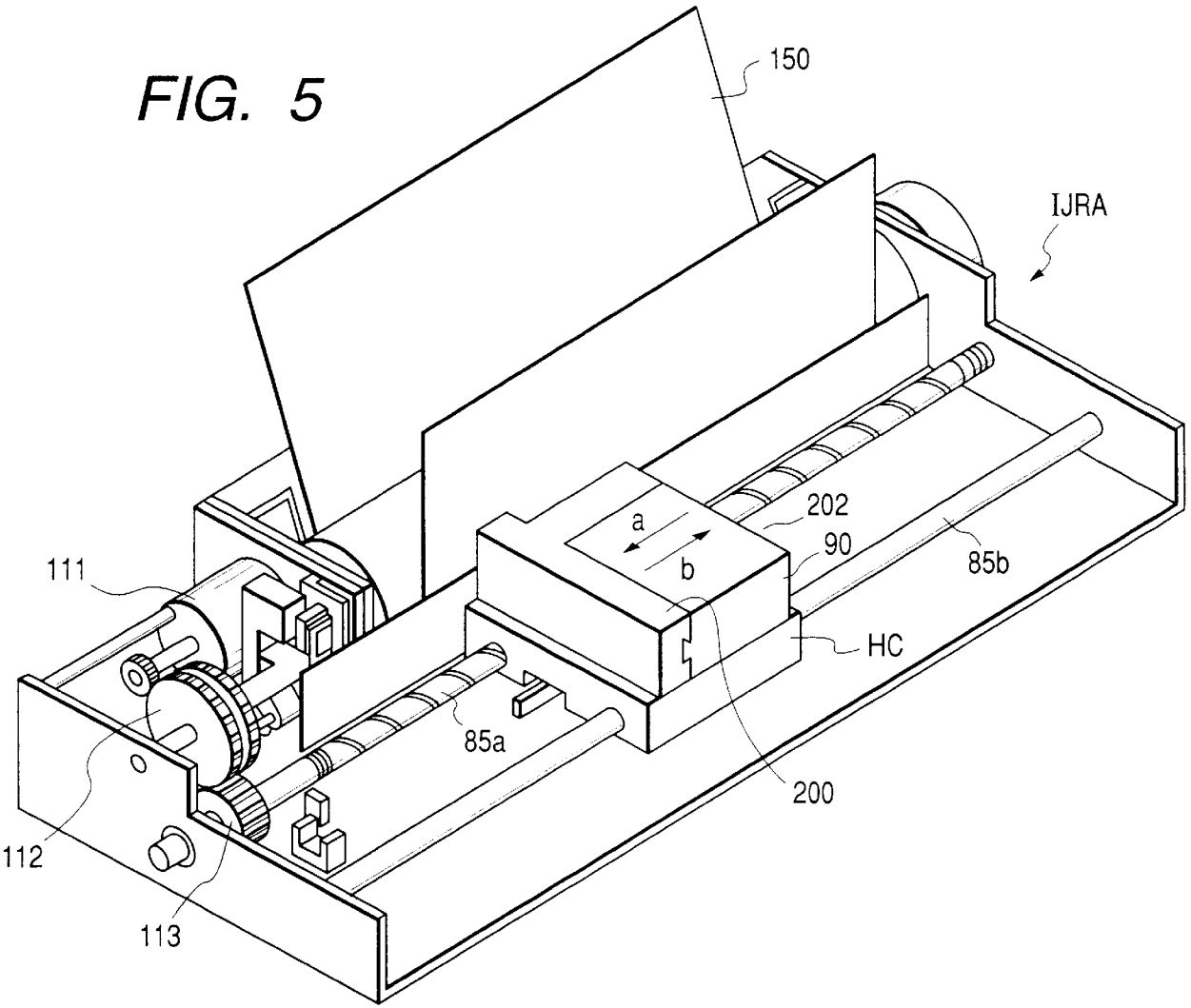
FIG. 5 is a perspective view showing a liquid discharge apparatus in which the liquid discharge head shown in FIG. 1 is mounted.

FIG. 5 is a perspective view of a liquid discharging apparatus in which the above-described liquid discharge head is mounted. In the present embodiment, there will be explained in particular an ink jet recording apparatus IJRA employing ink as the discharge liquid. As shown in FIG. 5, a carriage HC provided in the apparatus IJRA supports a head cartridge 202 in which a liquid container 90 containing ink and a liquid discharge head 200 are detachably mounted. The recording apparatus IJRA is also provided with recording medium conveying means, and the carriage HC reciprocates in the transversal direction (indicated by arrows a, b) of the recording medium 150 such as a recording sheet conveyed by the recording medium conveying means. When a drive signal is supplied from an unrepresented drive signal source to the liquid discharge head 200 on the carriage HC in the recording apparatus IJRA, the liquid discharge head 200 discharges the recording liquid toward the recording medium 150 in response to such drive signal.

The recording apparatus IJRA is further provided with a motor 111, gears 112, 113 and carriage shafts 85*a*, 85*b* for transmitting the power of the motor 111 to the carriage HC, thereby driving the recording medium conveying means and the carriage HC. Satisfactory recorded images can be obtained by discharging liquid to various recording media by the recording apparatus IJRA.

Figure 6:
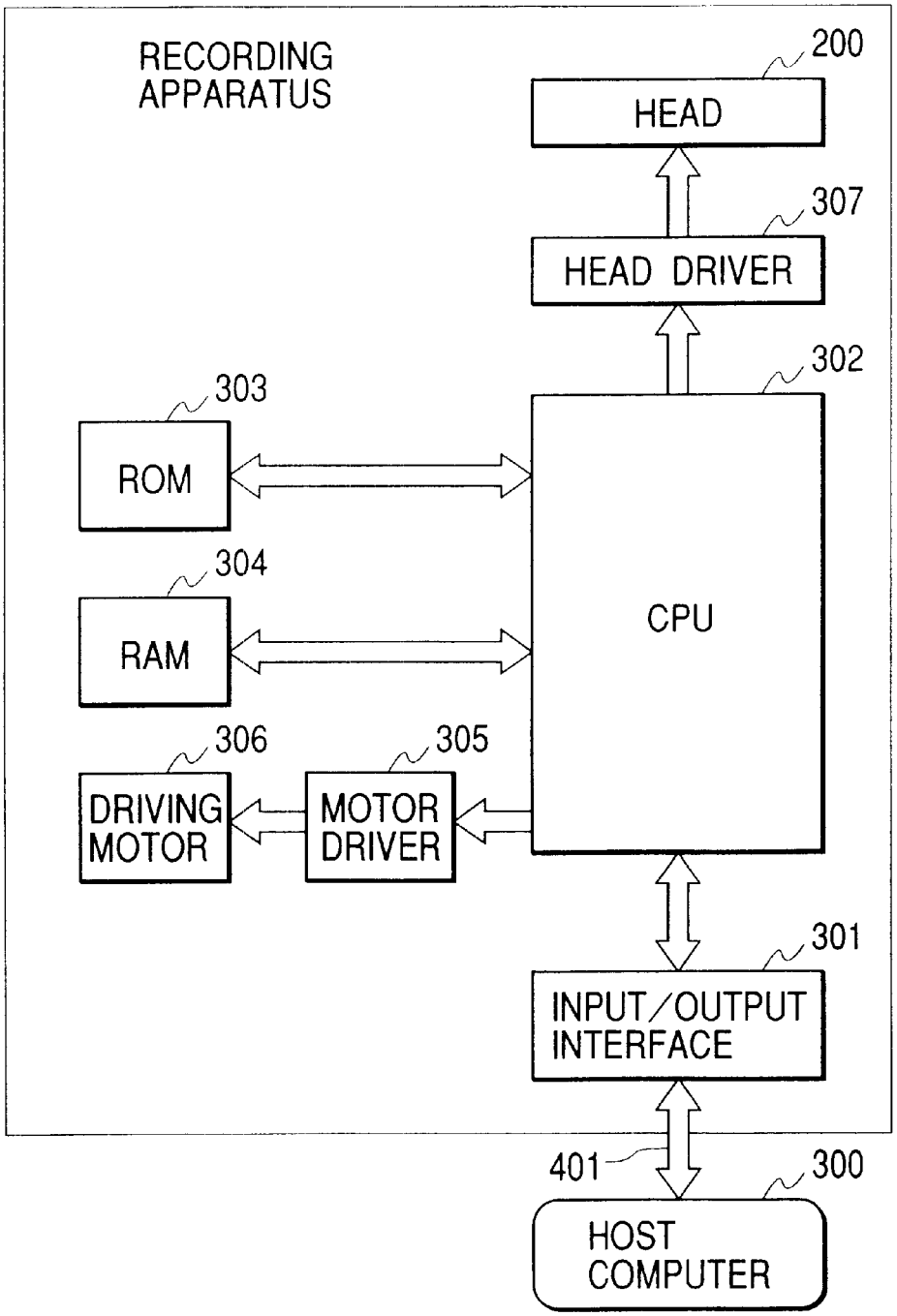
FIG. 6 is a block diagram of the entire liquid discharge apparatus employing the liquid discharge head shown in FIG. 1.

FIG. 6 is a block diagram of the entire apparatus for driving the ink jet recording apparatus employing the liquid discharge head of the present invention.

As shown in FIG. 6, the recording apparatus receives the print information from a host computer 300, as a control signal 401. The print information is temporarily stored in an input/output interface 301 in the recording apparatus, and also converted into data processable in the recording apparatus and entered into a CPU 302 serving also as drive signal supply means. The CPU 302 processes the data entered thereto, utilizing peripheral units such as a RAM 304 and based on a control program stored in a ROM 303, thereby converting the data into print data (image data).

Also the CPU 302 prepares data for driving a motor 306 for moving recording sheet and the liquid discharge head 200 in synchronization with the image data, in order to record the image data in an appropriate position on the recording sheet. Simultaneous with the transmission of the image data through the head driver 307 to the liquid discharge head 200, the motor driving data are transmitted to the motor 306 through the motor driver 305. Thus the liquid discharge head 200 and the motor 306 are respectively driven at the controlled timing to form an image.

The recording medium applicable to the above-described recording apparatus and subjected to deposition of liquid such as ink can be various papers, an OHP sheet, plastic materials employed in the compact disk or decoration plates, cloth, a metal plate such as of aluminum or copper, cow or pig leather, artificial leather, wood or plywood, bamboo, plastics such as a tile, a three-dimensionally structured material such as sponge etc.

Also the above-described recording apparatus includes a printer for recording on various papers or OHP sheet; a plastics recording apparatus for recording on plastics such as a compact disk; a metal recording apparatus for recording on metal; a leather recording apparatus for recording on leather; a wood recording apparatus for recording on wood; a ceramic recording apparatus for recording on ceramics; a recording apparatus for recording on a three-dimensionally structure material such as sponge; and a dyeing apparatus for recording on cloth.

The discharge liquid to be employed in such liquid discharge apparatus can be designed according to respective recording medium and recording conditions.

What is claimed is:

1. A liquid discharge head provided with an element substrate and a ceiling plate fixed in a mutually opposed state, plural liquid path lateral walls provided between said ceiling plate and said element substrate and defining plural liquid flow paths, plural discharge energy generating elements arranged in parallel on the surface of said element substrate so as to be respectively positioned in said plural liquid paths, plural movable members in the form of a cantilever supported at an end, provided on said element substrate so as to be respectively opposed to said plural discharge energy generating elements and provided with fixed ends at the upstream side in the liquid flowing direction in said liquid paths and free ends at the downstream ends, and plural projections provided on said ceiling plate for respectively limiting the amount of displacement of said plural movable members, said element substrate and said ceiling plate having similar materials;

wherein said liquid path lateral walls are formed on said element substrate, and, on said ceiling plate, there is provided an engaging layer having recesses for fitting with the upper end faces of said liquid path lateral walls, wherein said engaging layer is further provided with said projections.

2. A liquid discharge head provided with an element substrate and a ceiling plate fixed in a mutually opposed state, plural liquid path lateral walls provided between said ceiling plate and said element substrate and defining plural liquid flow paths, plural discharge energy generating elements arranged in parallel on the surface of said element substrate so as to be respectively positioned in said plural liquid paths, plural movable members in the form of a cantilever supported at an end, provided on said element substrate so as to be respectively opposed to said plural discharge energy generating elements and provided with fixed ends at the upstream side in the liquid flowing direction in said liquid paths and free ends at the downstream ends, and plural projections provided on said ceiling plate for respectively limiting the amount of displacement of said plural movable members, said element substrate and said ceiling plate having similar materials; wherein said liquid path lateral walls are formed on said element substrate, and, on said ceiling plate, there is provided an engaging layer having said projections.

3. A liquid discharge head according to claim 1, wherein said engaging layer and said liquid path lateral walls include similar materials.

4. A liquid discharge head according to claim 3, wherein said engaging layer and said liquid path lateral walls are formed with silicon nitride.

5. A liquid discharge head according to claim 1, wherein the recesses of said engaging layer are closed at the side of the discharge opening.

6. A liquid discharge head according to claim 1, wherein said engaging layer is composed of a high molecular material such as cured epoxy resin, polyimide resin, polyetheramide resin or aramid resin.

7. A method for producing the liquid discharge head according to claim 1 or 2, comprising:

a step of depositing an organic material layer on said ceiling plate consisting of an inorganic material and partially removing said inorganic material layer thereby forming said projections and said recesses.

8. A liquid discharge apparatus comprising a carriage supporting a liquid discharge head according to claim 1 or 2.

9. A liquid discharge head provided with an element substrate and a ceiling plate fixed in a mutually opposed state, plural liquid path lateral walls provided between said ceiling plate and said element substrate and defining plural liquid flow paths, plural discharge energy generating elements arranged in parallel on the surface of said element substrate so as to be respectively positioned in said plural liquid paths, plural movable members in the form of a cantilever supported at an end, provided on said element substrate so as to be respectively opposed to said plural discharge energy generating elements and provided with fixed ends at the upstream side in the liquid flowing direction in said liquid paths and free ends at the downstream ends, and plural projections provided on said ceiling plate for respectively limiting the amount of displacement of said plural movable members, said element substrate and said ceiling plate having similar materials, wherein said liquid path lateral walls are formed on said element substrate, and, on said ceiling plate, there is provided an engaging layer having recesses for fitting with the upper end faces of said liquid path lateral walls, and wherein said projection at least at the upstream side of the liquid path has an angle θ, with respect to the contact face with the movable member, within a range of 100° to 45° both at the upstream and downstream sides of the liquid path.

10. A liquid discharge head according to claim 9, wherein said projection at least at the upstream side of the liquid path has an angle θ, with respect to the contact face with the movable member, within a range of 90° to 60° both at the upstream and downstream sides of the liquid path.

* * * * *

UNITED STATES PATENT AND TRADEMARK OFFICE

CERTIFICATE OF CORRECTION

PATENT NO. : 6,378,993 B1 
DATED : April 30, 2002
INVENTOR(S) : Teruo Ozaki et al.

It is certified that error appears in the above-identified patent and that said Letters Patent is hereby corrected as shown below:

Title page,
Item [56], References Cited, FOREIGN PATENT DOCUMENTS,
"EP 9048127 2/1997
EP 9201996 8/1997" should read
-- JP 9-048127 2/1997
JP 9-201966 8/1997 --.

Column 2,
Line 4, "example" should read -- example, --.

Column 6,
Line 33, "a" should read -- as --.

Column 8,
Line 17, "1 hours" should read -- 1 hour --.

Column 10,
Line 1, "structure" should read -- structured --;
Line 22, "materials;" should read -- materials, --; and
Line 27, "walls," should read -- walls, and --.

Signed and Sealed this

Twenty-sixth Day of August, 2003

JAMES E. ROGAN
*Director of the United States Patent and Trademark Office*